United States Patent [19]

Schlafly

[11] 4,395,192

[45] Jul. 26, 1983

[54] BOOM CYLINDER

[75] Inventor: Paul W. Schlafly, New Philadelphia, Ohio

[73] Assignee: The Warner & Swasey Company, Cleveland, Ohio

[21] Appl. No.: 227,020

[22] Filed: Jan. 19, 1981

[51] Int. Cl.[3] ..... E02F 3/00

[52] U.S. Cl. ..... 414/718; 212/268

[58] Field of Search ..... 414/694, 718, 749; 212/230, 231, 264, 268, 269; 92/51, 66, 161.5

[56] References Cited

U.S. PATENT DOCUMENTS

| | | | |
|---|---|---|---|
| 3,069,033 | 12/1962 | Ferwerda | 414/718 |
| 3,329,291 | 7/1967 | Przybylski et al. | 414/718 |
| 3,353,686 | 11/1967 | Cowan | 212/231 |
| 3,493,133 | 2/1970 | Mrozek | 414/718 X |
| 3,610,433 | 10/1971 | Milner | 414/718 X |
| 3,666,125 | 5/1972 | Gano et al. | 414/718 |
| 3,700,126 | 10/1972 | Beaton | 414/718 |
| 4,094,230 | 6/1978 | Wright et al. | 212/268 X |

*Primary Examiner*—Robert J. Spar
*Assistant Examiner*—Terrance L. Siemens
*Attorney, Agent, or Firm*—Howard G. Massung

[57] ABSTRACT

An improved material handling apparatus boom cylinder structure. A hydraulic cylinder is provided inside an outer boom and an inner boom in order to provide a method for slidably moving the inner boom relative to the outer boom. Affixed to the hydraulic boom cylinder is a boom cylinder support adapted to engage the internal structure of the inner boom in order to provide support for the hydraulic cylinder.

6 Claims, 6 Drawing Figures

BOOM CYLINDER

BACKGROUND OF THE INVENTION

This invention relates generally to a boom structure and more particularly to a boom structure having telescoping sections which are guided relative to each other by rollers. More specifically, the instant invention relates to a means for causing the telescoping boom sections to move relative to each other by means of a hydraulic cylinder having one end thereof affixed to a boom cradle and the other end affixed to one of said boom sections, such that upon actuation of the hydraulic cylinder, the boom sections may be moved relative to each other. A cylinder support is affixed to the hydraulic cylinder in order to maintain the axial alignment of the barrel and rod of the hydraulic cylinder when the hydraulic cylinder is in an extended position and at all other times.

Boom structures having telescoping boom sections which are movable relative to each other by means of a hydraulic cylinder are well known as exemplified by U.S. Pat. No. 3,666,125 to Gano et al and U.S. Pat. No. 3,329,291 to Przybylski et al, both of which are specifically incorporated by reference herein. The above noted patents disclose a boom structure and hydraulic actuating cylinder arrangement employed by the Gradall Hydraulic Excavator manufactured by The Warner & Swasey Company, New Philadelphia, Ohio.

The prior art typically employs an outer boom section having a telescoping inner boom section slidably movable therein with the rod end of a hydraulic cylinder affixed to the outer boom and the barrel of the hydraulic cylinder affixed to the inner boom in order to provide a means for relative movement between the inner and outer booms. For instance, as more fully disclosed in U.S. Pat. No. 3,329,291, FIG. 3, the outer boom 72 has affixed thereto the rod member 93 of hydraulic cylinder 90 with the barrel 92 of the hydraulic cylinder affixed to the inner boom 71. The barrel 92 of the hydraulic cylinder is affixed to the inner boom 71 at a point toward the middle of the barrel 92 in order to reduce cylinder droop caused by excessively long unsupported portions of the hydraulic cylinder when in the extended position. Hydraulic fluid is provided to the cylinder 90 through manifold 100 into hollow rod member 93 and subsequently into the barrel 92 to effect movement of the rod relative to the barrel.

While this known boom cylinder arrangement has been generally satisfactory, it does present some disadvantages. Specifically, the use of a hydraulic cylinder employing a hollow rod in order to provide means for actuation requires additional expense in the fabrication of the hydraulic cylinder itself, and in addition requires the use of a manifold for porting the hydraulic fluid to and from the rotating hydraulic cylinder with the attendant expense, maintenance and wear problems associated with the use of a manifold. P The instant invention overcomes the disadvantages of the prior art by providing a boom cylinder structure employing a conventional hydraulic cylinder structure adapted to remain stationary relative to the boom carrier and therefore does not require a hollow rod or a manifold. A boom cylinder support is provided in order to eliminate the problems associated with an extended boom cylinder supported only at its ends.

SUMMARY OF THE INVENTION

The present invention relates to a boom cylinder structure having one end of said boom cylinder affixed to a boom carrier and the other end of said hydraulic cylinder affixed to an inner boom in order to provide relative movement of the inner boom relative to an outer boom upon actuation of the hydraulic cylinder.

A hydraulic cylinder is fixedly attached by a pivot means to a boom carrier having an outer boom contained therein and adapted to be rotated within said boom carrier. The rod end of the hydraulic cylinder is affixed to the inner boom in order to provide relative movement of the inner boom with respect to the outer boom upon actuation of the hydraulic cylinder. A cylinder support means is rotatably affixed to the unattached end of the hydraulic cylinder barrel with a roller means adapted to support the hydraulic cylinder barrel within the inner boom by means of a series of rollers adapted to maintain a rolling relationship within the inner boom.

DESCRIPTION OF THE PREFERRED EMBODIMENT

Figure 1:
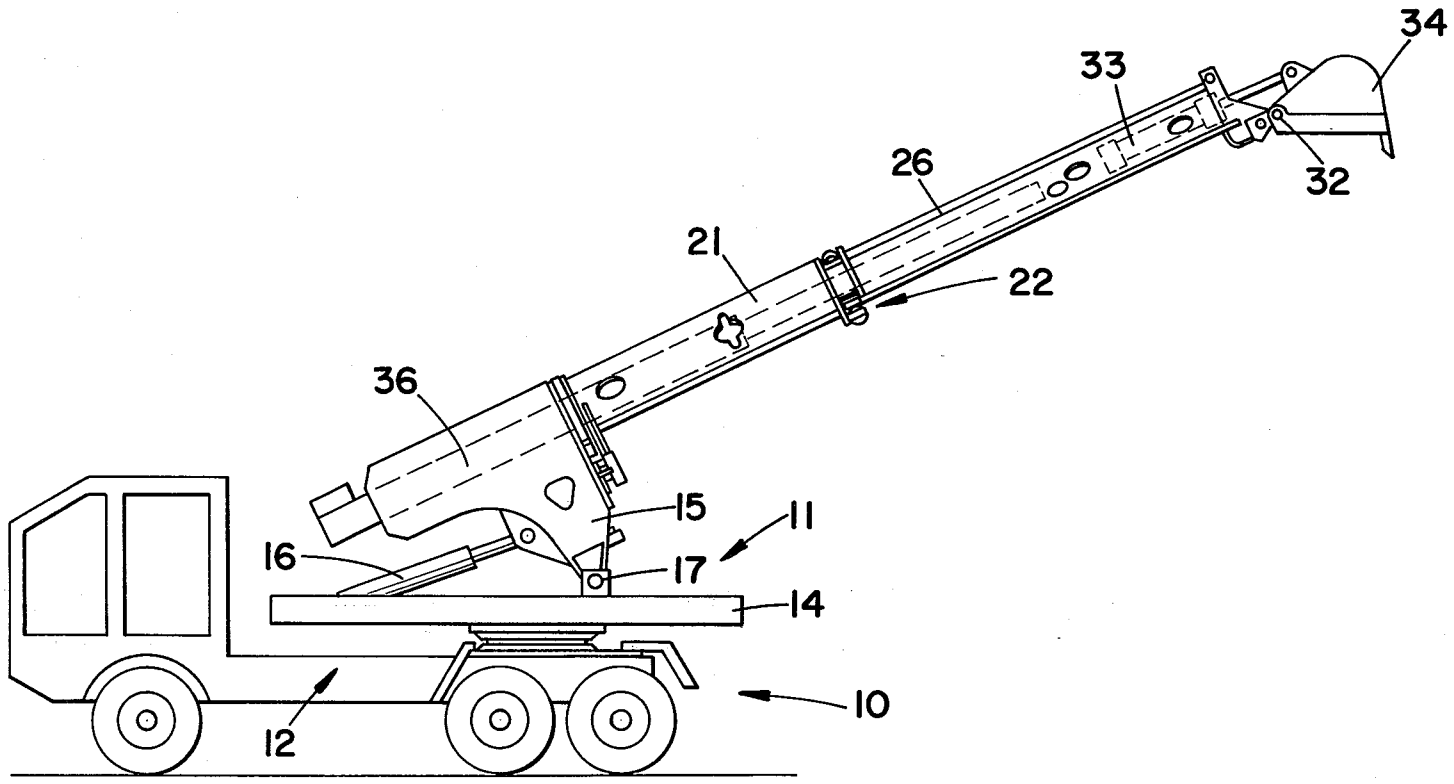
FIG. 1 is a front elevation of a material handling apparatus embodying the instant invention.

Referring now to FIG. 1 of the drawings, there is disclosed a material handling apparatus 10 particularly adapted to excavate earth. The material handling apparatus is comprised of an upperstructure designated 11 and a carrier 12 having motive means. The upperstructure 11 is attached to the carrier 12 in such a manner as to allow rotation of the upperstructure 11 on the carrier 12. The carrier 12 allows the material handling apparatus to be transported to various job locations under its own power. The use of a carrier to transport a rotating upperstructure having telescoping boom sections actuated by a hydraulic cylinder is well known in the art as exemplified by the Gradall Hydraulic Excavator manufactured by The Warner & Swasey Company, New Philadelphia, Ohio, and more fully disclosed in the Gradall Model G-660 Service Manual and the Gradall Model G-1000 Service Manual, both of which are specifically incorporated by reference herein.

Pivotally mounted to the upperstructure 11 on the platform 14 is a boom cradle 15. Affixed to the boom cradle 15 is a hydraulic cylinder 16 mounted in such a fashion as to cause the boom cradle to pivot about pivot pin 17 when the hydraulic cylinder is either extended or retracted. Outer boom 21 is adapted to rotate within the boom cradle 15 and pivot with the boom cradle 15 about the pivot pin 17 when the hydraulic cylinder 16 is actuated. The outer boom roller assembly 22 is located at the outer end of the outer boom 21.

Disposed within the outer boom 21 and slidable therein is inner boom 26. The inner boom 26 rides on the outer boom rollers 22 and is further supported within the outer boom 21 by means of inner boom roller assembly 27 (see FIG. 3) affixed to the inner end of the inner boom 26. It can thus be seen that there is provided means for allowing the inner boom 26 to be slidably disposed within the outer boom 21 by support means provided by the outer boom rollers 22 affixed to the outer end of the outer boom 21 and further by the inner boom rollers 27 affixed to the inner end of the inner boom 26.

Disposed within the inner boom 26 and the outer boom 21 is a hydraulic cylinder 36 having one end thereof affixed to the inner boom 26 and the other end of said hydraulic cylinder 36 affixed to the boom cradle 15 such that the inner boom 26 may be slidably moved relative to the outer boom 21 upon actuation of the hydraulic cylinder 36. Pivotally affixed to the outer end of the inner boom 26 is a bucket 34 which pivots about pivot pin 32. Also attached to the bucket 34 is a hydraulic cylinder 33 having one end attached to the bucket 34 and the other end affixed to the inner boom 26 such that when the hydraulic cylinder 33 is retracted or extended the bucket 34 is caused to be pivoted about the pivot pin 32.

It may now be appreciated that there is shown a material handling apparatus particularly adapted for the movement of material from one location to another by use of hydraulic cylinders 16, 36, and 33 and the rotating movement of the platform 14 on the carrier 12.

Figure 2:
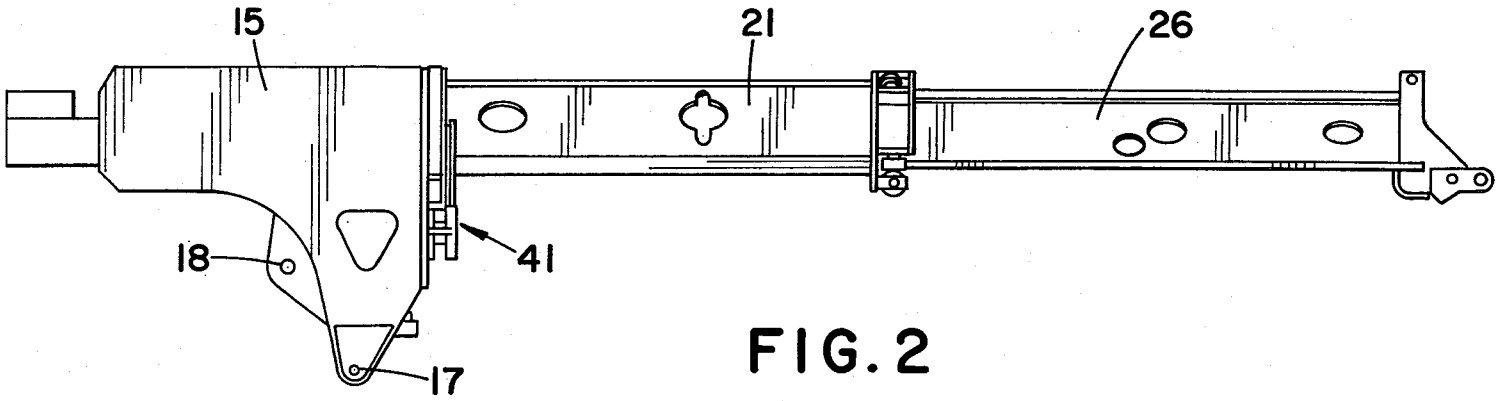
FIG. 2 is an enlarged portion of the boom structure shown in FIG. 1.

Referring now to FIG. 2 of the drawings, there is disclosed the boom cradle 15, outer boom 21, and inner boom 26. As can be more readily seen in FIG. 2, the boom cradle 15 pivots about the cradle pivot pin 17 in response to the actuation of a hydraulic cylinder affixed to the boom cradle 15 by means of cylinder pin connection 18. The boom rotation apparatus 41 may be utilized to rotate the outer boom 21 and hence the inner boom 26. The details for providing this movement are more fully disclosed in U.S. Pat. No. 3,329,291 to Przybylski et al.

The structure of the outer boom 21 and the inner boom 26 is more fully described in the U.S. Patent Application of Patrick T. Hogan, Ser. No. 221,652 filed Dec. 31, 1980, which application is specifically incorporated by reference herein.

Figure 6:
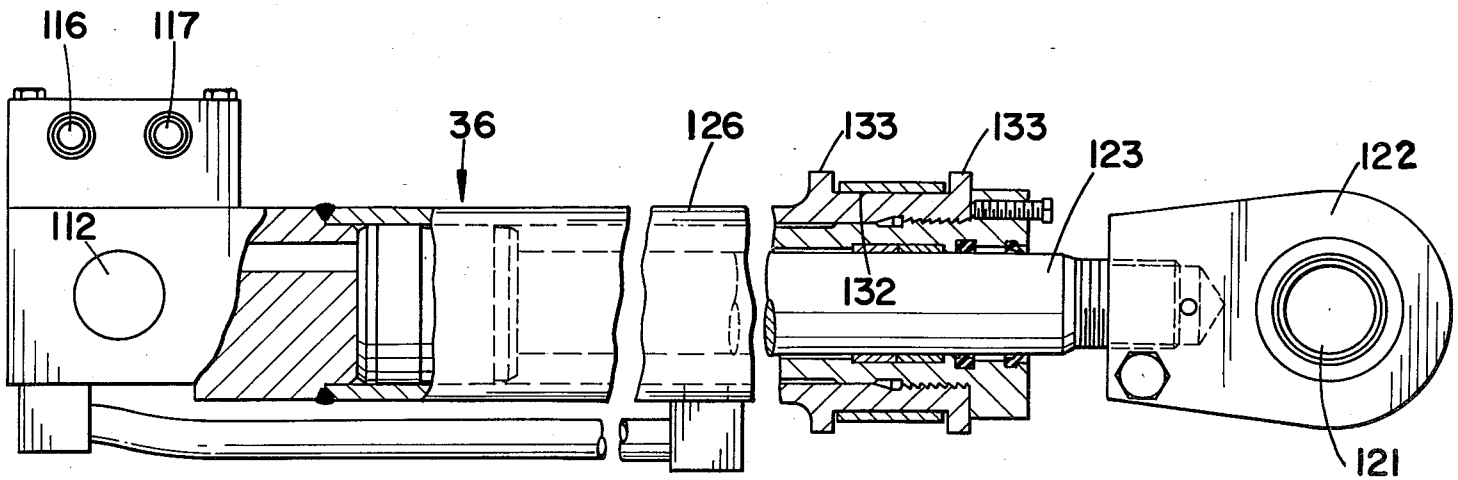
FIG. 6 is a partial sectional view of the hydraulic cylinder employed in the instant invention.
Figure 3:
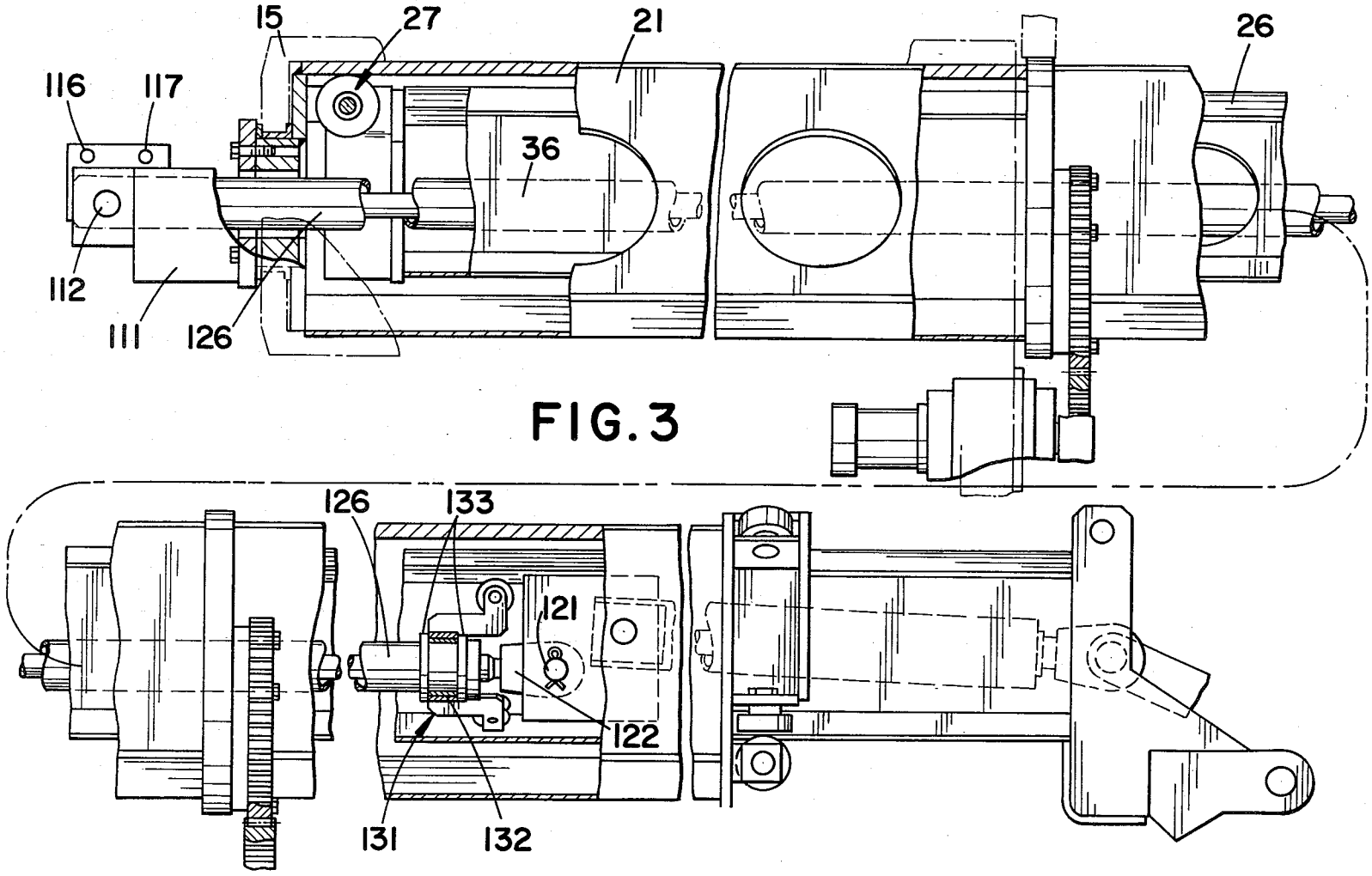
FIG. 3 is an enlarged portion of FIG. 2 with sections broken away.

Referring now to FIGS. 3 and 6 of the drawings, there is disclosed a portion of the boom cradle 15, outer boom 21, and inner boom 26. Affixed to the boom cradle 15 is hydraulic cylinder mounting bracket 111 having means for receiving pin 112 which is adapted to retain the hydraulic cylinder 36 for pivoting movement about the pin 112.

The rod end of the hydraulic cylinder is affixed to the inner boom 26 by means of pin 121 engaging the clevis 122 of hydraulic cylinder rod 123. The hydraulic cylinder 36 is actuated by fluid under pressure provided to the hydraulic cylinder 36 through hydraulic conduits 116 and 117.

It can thus be seen that the inner boom 26 may be moved relative to the outer boom 21 by means of supplying the appropriate hydraulic fluid pressure to the hydraulic lines 116 and 117.

Affixed to the barrel 126 of the hydraulic cylinder 36 is the boom cylinder support 131. The boom cylinder support 131 is rotatably mounted to the hydraulic cylinder barrel in order to allow the boom cylinder support to rotate with the inner boom 26 while the hydraulic cylinder barrel 126 remains stationary. The boom cylinder support rotates about the barrel 126 on a bearing 132. The boom cylinder support 131 and the bearing 132 are constrained axially on the barrel 126 by means of flanges 133 which maintain the boom stabilizer in the appropriate position on the hydraulic cylinder barrel 126.

Figure 4:
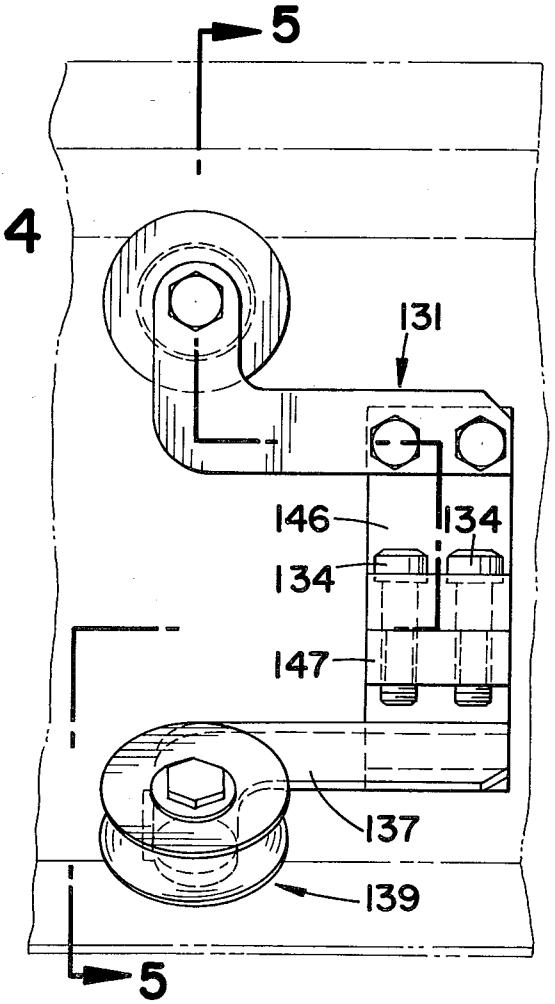
FIG. 4 is a side elevation of the cylinder support shown in FIG. 3.
Figure 5:
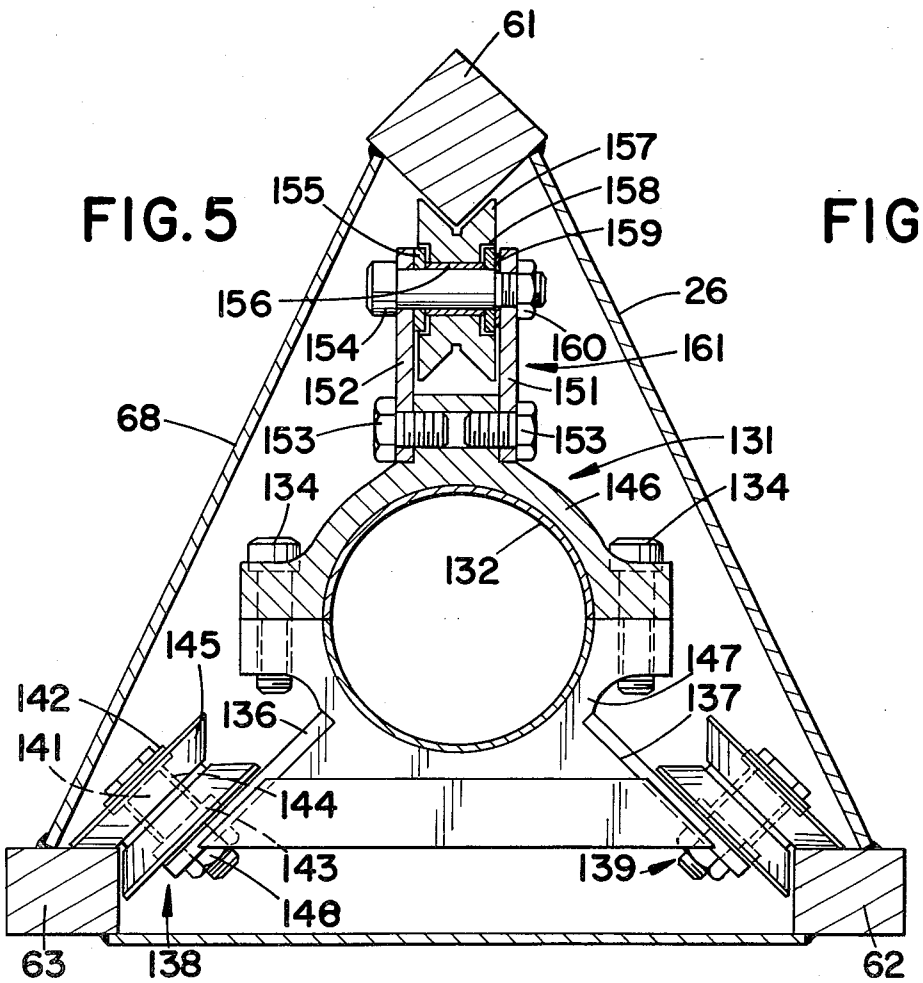
FIG. 5 is a cross sectional view taken along the line 5—5 shown in FIG. 4.

Referring now to FIGS. 4 and 5 of the drawings, there are shown further details of the boom cylinder support 131. The boom cylinder support 131 comprises a split clamping member having an upper portion 146 and a lower portion 147 which are clamped around the barrel 126 and by means of bolts 134. The lower clamping member 147 has two mounting flanges 136 and 137 to which are mounted roller assemblies 138 and 139.

Each of the roller assemblies 138 and 139 is comprised of a retaining bolt 141, spacers 142 and 143, bearing 144 upon which is journaled roller 145 and retaining nut 148. It may be appreciated that the roller 145 is retained rotatably on the retaining bolt 141 in a spacial relationship to coact with the elongated member 63 of the inner boom 26 in order to provide a supporting function to the clamping member 147. The roller assembly 139 maintains a similar relationship with respect to the elongated member 62.

The upper clamping member 146 has a flange to which are bolted two mounting brackets 151 and 152 by means of bolts 153. The mounting brackets 151 and 152 support roller assembly 161 which is comprised of a retaining bolt 154, a spacer 155, a bushing 156, a roller 157, spacers 158, 159 and retaining nut 160. The roller 157 is journaled on the bearing 156 and rotates about the axis of the retaining bolt 154 in substantial contact with the elongated member 61 of the inner boom 26 in order to provide a spacial relationship between the clamping member 146 and the elongated member 61.

It may now be appreciated that there is provided a supporting member having roller means continuously supporting the barrel of the hydraulic cylinder 36 within the inner boom such that the position of the barrel within the inner boom 26 remains substantially constant.

The supporting of the barrel of the hydraulic cylinder 36 eliminates three problems which may occur when a hydraulic cylinder is in an extended position. First, a hydraulic boom cylinder tends to droop when in an extended position due to the weight of the hydraulic cylinder. This drooping causes the axis of the barrel to become non-parallel with the axis of the rod resulting in excessive wear on the cylinder piston and packing thus causing premature leaking of the cylinder. Supporting the barrel of the hydraulic cylinder 36 substantially eliminates cylinder droop.

Vibrations are more readily induced in a hydraulic cylinder when it is in an extended position when the boom structure is started in motion or stopped. These vibrations can be substantially eliminated by supporting the barrel of the hydraulic cylinder.

Even further, the use of the boom cylinder support 131 reduces the amount of overlap of the barrel and rod needed in the extended position in order to keep cylinder droop at a minimum.

I claim:

1. A material handling vehicle comprising:

an upper structure;

an outer boom rotatable about its longitudinal axis;

an inner boom rotatable with said outer boom about their common longitudinal axis and partially disposed for telescopic positioning within said outer boom and said inner boom supporting a material handling device at its exposed end;

a boom cradle, pivotally supported from said upper structure, supporting said outer boom for rotation about its longitudinal axis;

a hydraulic cylinder, not rotatable with said outer boom, having one end connected to said boom cradle and having operating rod means extending from the other end thereof which engages and permits said inner boom to rotate around its longitudinal axis with respect to said hydraulic cylinder and for telescopic positioning of said inner boom with respect to said outer boom; and, a cylinder support, longitudinally fixed in close proximity to the rod end of said cylinder, providing support for the end of said cylinder from the inside of said inner boom.

2. A material handling vehicle as claimed in claim 1 wherein:

said inner boom is rotatable about its longitudinal axis only with said outer boom; and comprising, rotating means for rotating said outer boom.

3. A material handling vehicle as claimed in claim 1 comprising:

bearing means disposed between said cylinder and said inner boom for rotatably supporting said cylinder with respect to said inner boom.

4. A material handling vehicle comprising, a hydraulic extendable boom excavator having a rotatable outer boom, an inner boom rotatable with said outer boom about their common longitudinal axis and slidably disposed partially within said outer boom, a hydraulic boom cylinder for positioning said inner boom relative to said outer boom, the improvement characterized by:

an operating rod rotatable with respect to and extending from one end of said hydraulic boom cylinder and engaging said inner boom, and the other end of said hydraulic boom cylinder extending from said outer boom and said hydraulic boom cylinder is restrained against rotation with said outer boom and said inner boom; and, a cylinder support longitudinally fixed to the rod end of said hydraulic cylinder and providing support from the inner boom.

5. A material handling vehicle as claimed in claim 4 characterized by:

bearing means for connecting said cylinder support to said hydraulic cylinder for providing relative rotary motion therebetween.

6. A material handling vehicle as claimed in claim 4 characterized by:

a plurality of rollers supporting said cylinder support from the inside of said inner boom.

* * * * *